United States Patent [19]

Burkinshaw

[11] Patent Number: 4,580,776

[45] Date of Patent: Apr. 8, 1986

[54] COLLAPSIBLE STAGE

[76] Inventor: Phillip J. Burkinshaw, 1-3 Little Charles St., Abbotsford, Victoria 3067, Australia

[21] Appl. No.: 524,846

[22] Filed: Aug. 19, 1983

[30] Foreign Application Priority Data

Sep. 14, 1982 [AU] Australia ..... PF5883
Mar. 23, 1983 [AU] Australia ..... PF8577

[51] Int. Cl.[4] ..... A63J 3/00; E04B 1/344

[52] U.S. Cl. ..... 272/3; 52/183; 52/70; 108/112; 312/140.2; 312/258

[58] Field of Search ..... 272/3, 21, 25; 52/183, 52/188, 191, 70; 312/258, 107, 262, 140.2; 108/112, 64, 113, 114

[56] References Cited

U.S. PATENT DOCUMENTS

| | | | |
|---|---|---|---|
| 2,668,331 | 2/1954 | Horn | 108/112 |
| 2,890,089 | 6/1959 | Sanchez | 108/112 X |
| 2,953,244 | 9/1960 | Phillips | 312/140.2 X |
| 3,035,671 | 5/1962 | Sicherman | 52/183 |
| 3,434,769 | 3/1969 | Salet | 312/258 |
| 3,525,451 | 4/1970 | Asser . | |
| 4,122,638 | 10/1978 | O'Brian et al. | 312/258 X |
| 4,150,630 | 4/1979 | Pokorny et al. | 108/114 X |
| 4,289,362 | 9/1981 | Kramer | 312/258 X |
| 4,310,207 | 1/1982 | Adams, Jr. | 312/258 X |

FOREIGN PATENT DOCUMENTS 2028670 3/1980 United Kingdom .

*Primary Examiner*—Robert A. Hafer
*Assistant Examiner*—Arnold W. Kramer
*Attorney, Agent, or Firm*—Scully, Scott, Murphy & Presser

[57] ABSTRACT

Collapsible staging formed from modules each having end frames and side frames, the side frames incorporating vertical hinges allowing the side frames to be collapsed in a concertina fashion as the end frames are moved toward one another, so that the folded framework lies in a flat "sandwich" configuration. The frames support a platform which may be detached, or alternatively hinged to one end frame and also folded in a concertina fashion. Alternative configurations provide folding stairs and ramps.

8 Claims, 10 Drawing Figures

COLLAPSIBLE STAGE

Figure 2:
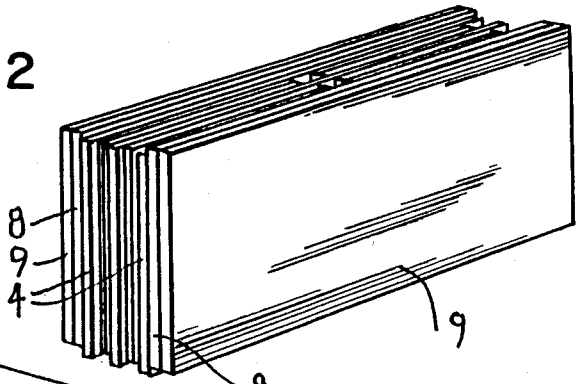

This invention relates to collapsible staging and has been devised particularly though not solely as a low level platform for bands etc., or as a module to be used in the formation of catwalks etc. The invention also envisages the provision of collapsible accessories for a platform or catwalk, such as collapsible ramps or collapsible stairs. Throughout this specification where the term "staging" is used it is to be understood to include within its ambit those other components normally used with platforms, such as ramps or stairs.

Where it is necessary to present various types of entertainment, for example bands or singing or other types of performance, or where it is necessary to provide a raised platform, for example as a catwalk at a fashion show it is often required to provide elevated staging to support an elevated platform for the display of the entertainment etc. In the past the staging has been provided in a number of different ways, for example by fabricating a custom-made framework from timber or by assembling a support framework from scaffold like components. These methods have the disadvantages that they are time consuming and therefor expensive to erect, and are difficult to transport and assemble.

It is therefor an object of the present invention to provide collapsible staging which will obviate or minimize the foregoing disadvantages in a simple yet effective manner or which will at least provide the public with a useful choice.

Accordingly the invention consists in a staging module having first and second end frames at either end thereof and side frames between said end frames, said side frames each comprising two rectangular sub-frames hinged together by a vertical central hinge along their common vertical edges and being connected to said end frames by vertical end hinges along the edges remote from the central hinge, said hinges being arranged such that the central hinges of opposite side frames can be moved toward one another causing the side frames to fold inwardly in a concertina fashion as the end frames are moved one towards the other, said staging module further incorporating a platform adapted to be placed on and supported by the upper peripheries of at least some of said frames, and engaging means between said platform and said frames adapted to prevent hinging movement of said frames, one relative to the other, when engaged with said platform.

In one form of the invention all of the frames are rectangular and of the same overall height providing a level platform.

In an alternative form of the invention the rectangular sub frames are of different heights, and the end frames are each of a height corresponding to the adjacent sub frames so that the module forms a pair of steps.

In yet a further alternative form of the invention the end frames are triangular in configuration so that the module forms an inclined ramp.

Although the invention has been described thus far as a staging module it will be appreciated that numbers of modules may be placed side by side or end for end to build a platform of a required size. Similarly a number of step modules of increasing size may be placed end for end to form a graduated flight of stairs.

Notwithstanding any other forms that may fall within its scope one preferred form of the invention will now be described by way of example only with reference to the accompanying drawings in which.

Figure 1:
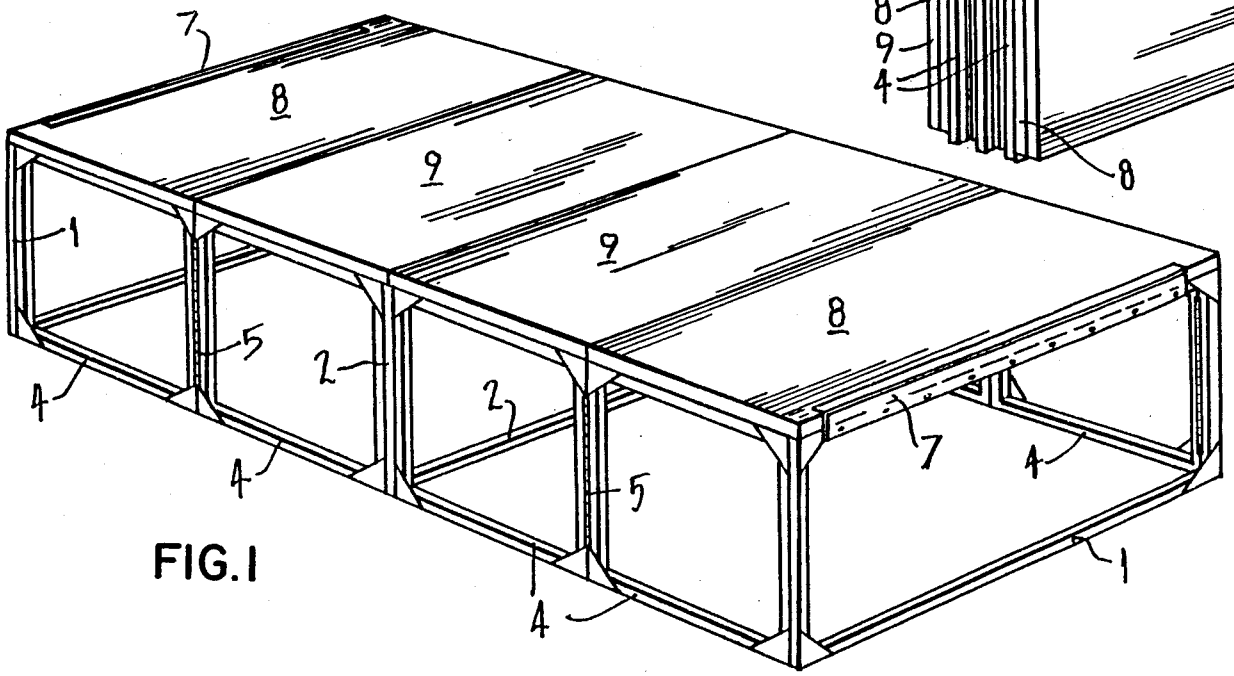
Figure 3:
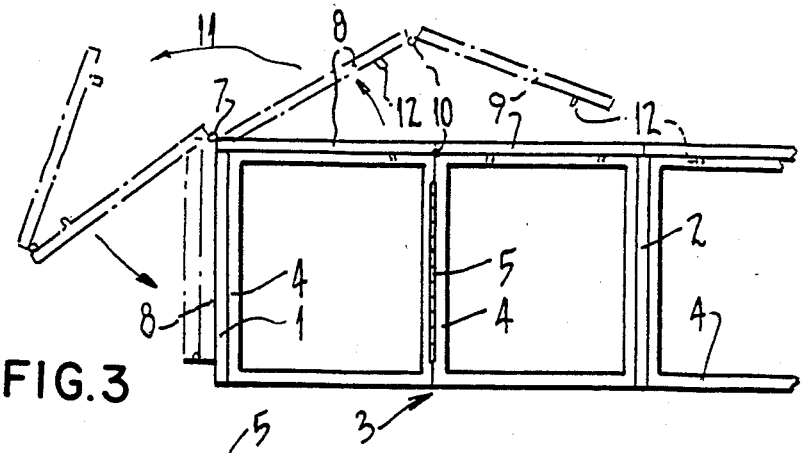
Figure 4:
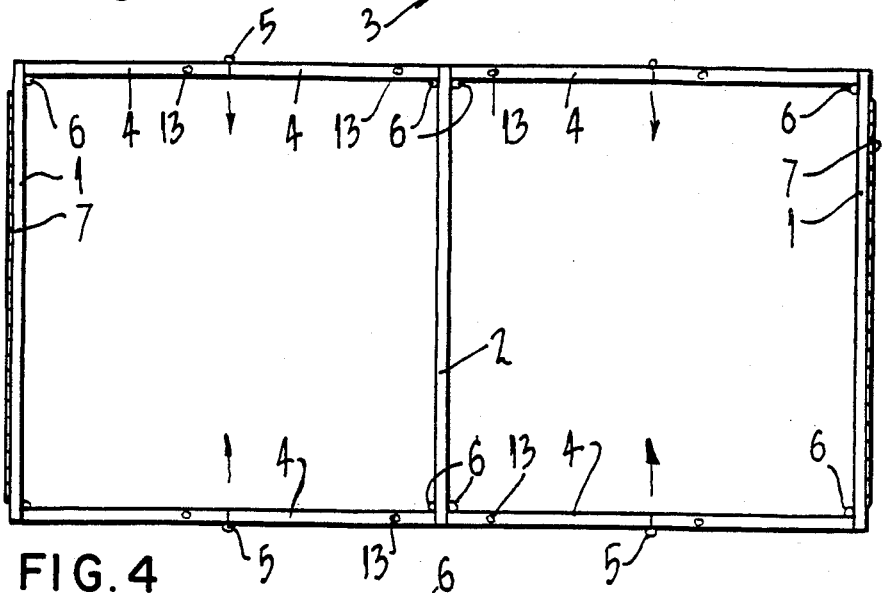
Figure 5:
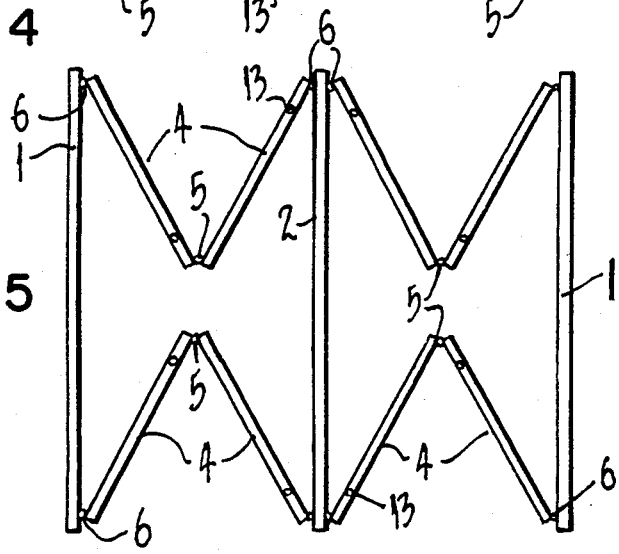
Figures 6, 7:
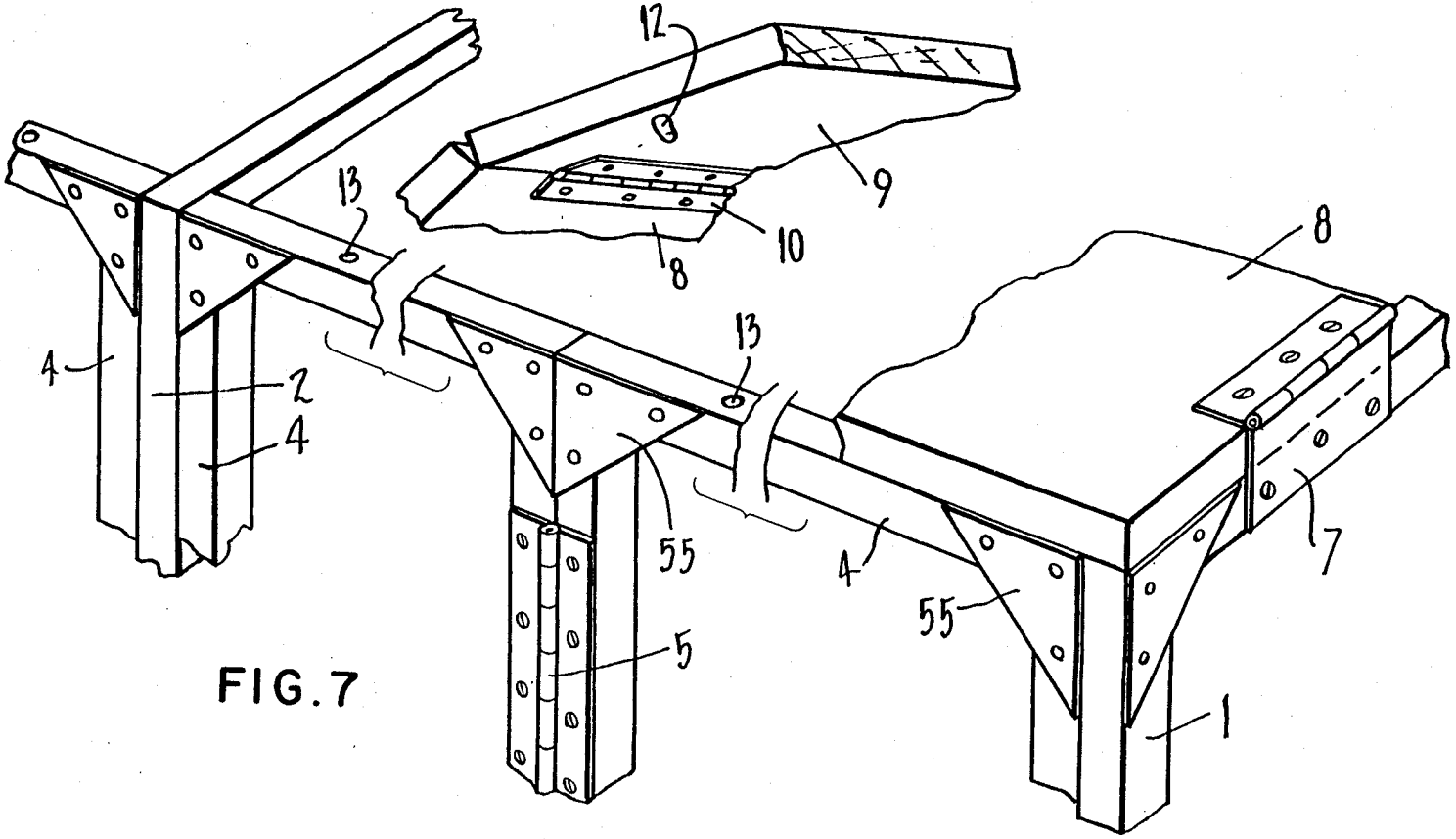
Figure 8:
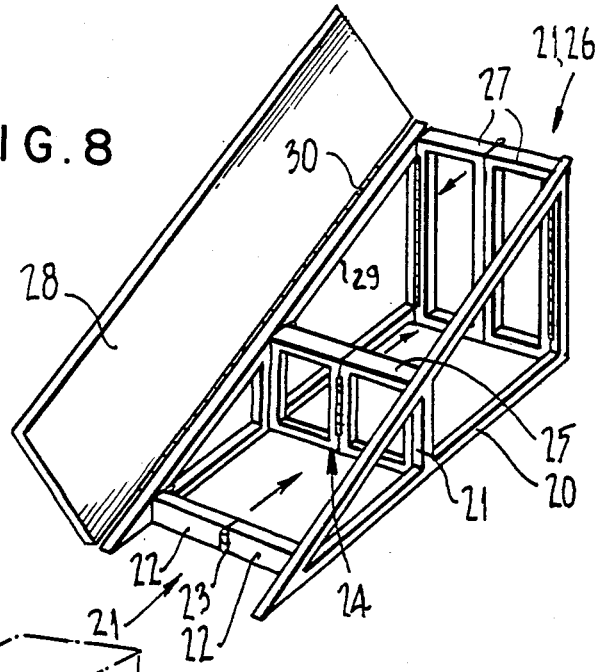
Figure 9:
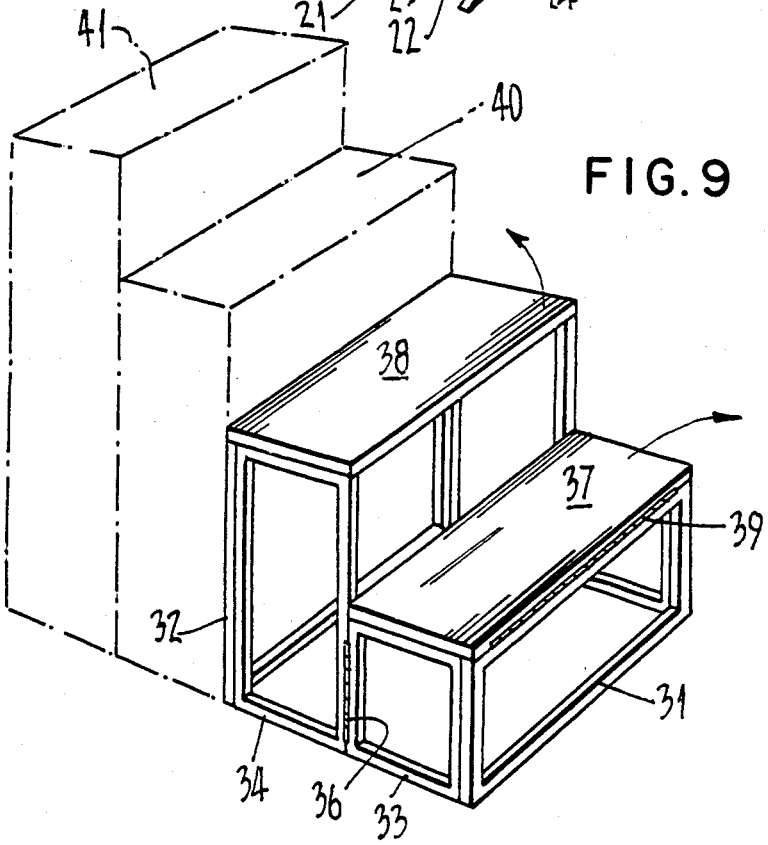
Figure 10:
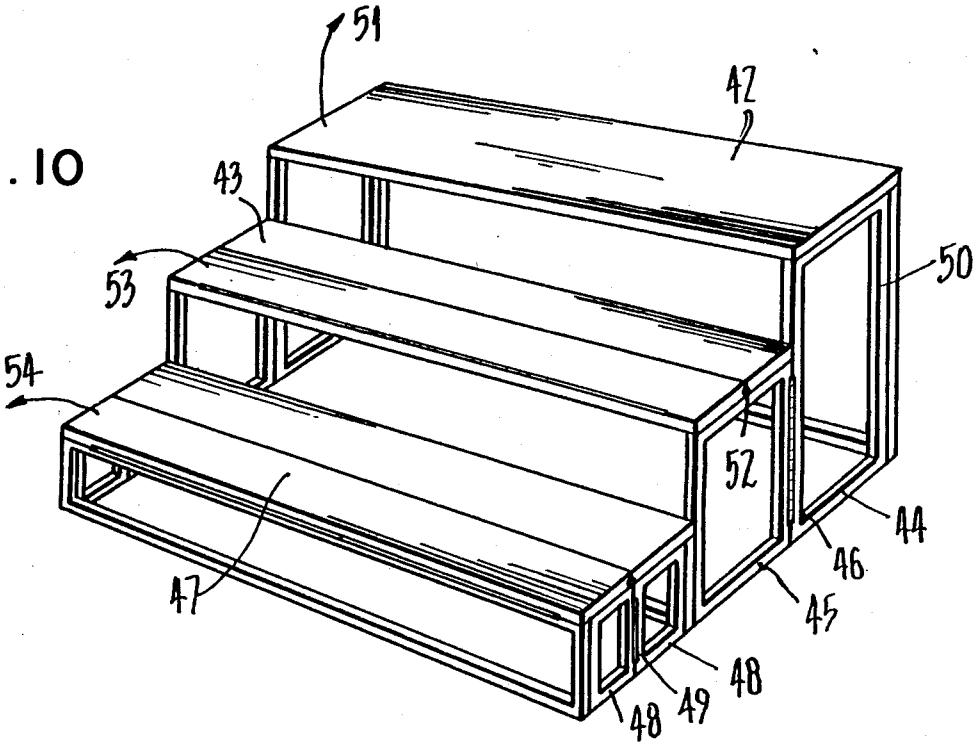

FIG. 1 is a perspective view of a double staging module according to the invention in the erected configuration, FIG. 2 is a perspective view of the double module shown in FIG. 1 in the folded configuration, FIG. 3 is a partial side view of the module shown in FIG. 1, showing the folding of the staging platform, FIG. 4 is a plan view of the framework of the module shown in FIG. 1 in the erected configuration, FIG. 5 is a plan view similar to FIG. 4 showing the framework in a partially folded position, FIG. 6 is an underside scrap view of the hinge line between the two halves of the platform shown in FIG. 3, FIG. 7 is a partial perspective view to an enlarged scale of the module shown in FIG. 1, showing the construction details of the framework, FIG. 8 is a perspective view of an alternative form of staging module in the form of an inclined ramp, FIG. 9 is a perspective view of a further alternative form of the invention in the form of a set of steps and, FIG. 10 is a perspective view of an alternative step configuration haVing three treads to the set of steps.

In the preferred form of the invention collapsible staging comprising two basic staging modules having a common end frame is constructed as follows with reference to FIGS. 1 to 7 of the accompanying drawings, although it will be appreciated that the basic staging module according to the invention comprises one half of the configuration shown in those drawings. FIGS. 8, 9 and 10 show various alternative configurations in the form of ramps or steps and once again it will be appreciated that the basic module may be made in a number of further alternative configurations to give various different staging modules.

Each staging module comprises rectangular end frames 1 and 2 which may for example be formed from top, bottom and side members of rectangular hollow section metal tubing, welded glued or otherwise fastened together. The actual construction of the frames can be seen more clearly with reference to FIG. 7 of the accompanying drawings.

The end frames are connected by side frames 3 each formed from two rectangular sub-frames 4 which once again are formed from hollow rectangular metal tubing. In the form of the invention as shown in FIGS. 1 to 7 where a raised level platform is provided the sub-frames and the end frames are all of the same height. Each pair of sub-frames are hinged together by a vertical central hinge 5 along their common vertical edges and are connected to the end frames 1 and 2 by vertical end hinges 6. The hinges are preferably continuous piano type hinges but may alternatively be formed from two or three individual hinges located on the hinge lines shown. The hinges are arranged so that the central hinges 5 of opposite side frames can be moved toward one another causing the side frames to fold inwardly in a concertina fashion as the end frames are moved one toward the other as can be clearly seen in FIG. 5. To this end the hinge pins of the hinges 5 are located on the outside of the framework when viewed in plan view and the hinge pins of the hinges 6 are located on the inside of the framework as can be seen in FIG. 4. The staging further comprises an upper platform which is placed on and supported by the upper peripheries of the frames. In the form of the invention shown in FIGS. 1 to 7 the platform is supported by the upper edges of all of the frames and sub-frames. In the preferred form of the invention the platform is formed from sheet material such as plywood or particle board and is attached to the framework by hinges 7 along the upper outer edges of the platform at either end of the collapsible staging. The platform above each module is preferably provided in two parts 8 and 9 fastened together by a further horizontal hinge 10 parallel to the hinge 7 at the mid-point of the platform located above the junction between the sub-frames 4. The pins of the hinges 7 are located coplanar with the upper surface of the platform as can be seen in FIGS. 3 and 7 so that the platform portion 8 may be rotated through 270° degrees in the direction of arrow 11 and the platforms moved through positions as shown in broken outline in FIG. 3 to lie alongside one another and alongside the end frames 1. Once the platform components have been folded as described and the sub-frames have been hinged inwardly as previously described the entire platform can be concertinaed into a very compact package as shown in FIG. 2.

Although the platform members have been described in one particular configuration it will be appreciated that they may be provided in many other alternative forms. For example the platforms may be in one piece and may be totally detachable from the frames rather than being hinged to the frames as previously described. In a further form of the double module shown in FIGS. 1 to 7 the four platform components may all be hinged together in an accordion pleat fashion and may all be folded to one end of the framework rather than to the two separate ends as previously described.

Engaging means are provided between the platform and the frames adapted to prevent hinging movement of the frames one to the other when the frames are engaged with the platform. In the preferred form of the invention the engaging means comprise pins 12 extending downwardly from the underside of the platform members, the pins engaging in holes 13 in the upper peripheral components of the sub-frames 4. The underside of the platforms 8 and 9 may also be provided with corresponding holes so that the pins are housed within the holes when the platform components are folded one against the other in the direction of arrow 11.

In use, the collapsible staging may be erected as shown in FIGS. 1 and 4 and the platforms located horizontally on top of the frames which are then prevented from folding by the pins 12 engaging in the holes 13. When it is desired to fold the staging for transportation or storage the platforms are lifted from the upper surface of the frames by rotating about the hinges 7 and 10 until the platforms lie alongside the end frames 1. The sub-frames 4 may then be folded inwardly as shown in FIG. 5 and the end frames 1 moved toward one another in the direction of arrows 14 (FIG. 4) until the end frames and the sub-frames all lie in parallel planes adjacent one another with the folded platforms on the outside of the "sandwich" as shown in FIG. 2. In this form the staging is extremely compact and simple to lift and carry for transportation or for storage.

Although the preferred form of the invention has been described as a double module it will be appreciated that the central frame 2 can be an end frame in its own right and the staging module can comprise one half of the size shown in FIGS. 1 to 7 of the accompanying drawings. Either single or double modules of the type described can be used in conjunction with other similar modules to build up a platform of the required size, either in rectangular arrays to create a large stage or alternatively by placing the modules end to end or side by side to create a long catwalk.

In alternative forms of the invention the module may be provided either in the form of an inclined ramp as shown in FIG. 8 or in the form of steps or stairs as shown in FIGS. 9 and 10. In the ramp configuration the end frames 20 are triangular in shape and are joined by side frames 21 of graduated height corresponding to the height of the end frame at that point. As may be seen in FIG. 8 the lower side frame may in fact simply be a two part bar 22 hinged in the middle at 23. The intermediate "side frame" 24 is composed of two rectangular sub-frames 25 and similarly the side frame 26 is also composed of rectangular sub-frames 27. The platform surface 28 is once again formed from sheet material such as plywood or particle board and in the form of the invention shown in FIG. 8 is hinged to the sloping upper rail 29 of one of the end frames by a continuous hinge 30. It will be appreciated however that the platform 28 may be detachable from the framework or may be provided in a number of smaller portions appropriately hinged together and to the framework. The folding operation of the ramp is the same as that of the module shown in FIGS. 1 to 7 in that the platform 28 is firstly hinged about the hinge 30 and then the side frames 21 are collapsed allowing the triangular end frames 20 to move toward one another and lie in a compact sandwich configuration.

In a further form of the invention a step module may be provided as shown in FIG. 9 wherein the end frames 31 and 32 are of different heights and are connected by sub-frames 33 and 34, each sub-frame being the same height as the height of the adjacent end frames. The sub-frames are hinged together by a vertical hinge 36 in a similar manner to the hinge 5 in the module described above and the sub-frames fold inwardly in a concertina fashion in the same manner as shown in FIG. 5.

The treads of the stair 37 and 38 are hinged by way of hinges 39 to their respective end frames 31 and 32 so that the treads may be rotated through 270° degrees to lie alongside their respective end frames before concertina folding of the sub-frames 33 and 34.

The steps may also be provided as a "double module" using the end frame 32 as a common end frame in the same manner as the end frame 2 of the configuration shown in FIGS. 1 to 7. The second half of the double module incorporates sub-frames of progressively taller configuration to form third and fourth steps 40 and 41 as shown in broken outline in FIG. 9. Various other configurations of the folding steps may also be provided to give the required size and height of finished stairway.

In one particular application of the folding steps the end frame of the tallest step may be fastened to the edge of a permanent platform or stage so that the steps may be unfolded from the front of the platform when access to the platform is required. Where it is difficult to hinge all of the treads onto the frames the treads may be totally removable and simply engaged with the frames by engaging downwardly protruding pins (not shown) on the underside of the platforms with corresponding holes in the upper frame members.

In a further interesting form of the step configuration, where it is desired to provide three graduated steps as shown in FIG. 10 the sub-frames may be of different widths as well as different heights. In this configuration the two upper treads 42 and 43 are supported by "conventional" one piece sub-frames 44 and 45 respectively hinged together by a vertical hinge 46 and the lower tread 47 is supported by a pair of smaller sub-frames 48 of the same height hinged together by a vertical hinge 49. The folding operation is exactly the same as that described for the previous configurations. The treads may all be hinged to the frames, for example the upper tread 42 is hinged by a continuous hinge along the rear edge of the platform and folded adjacent the end frame 50 as shown by arrow 51. The intermediate tread 43 may be provided in two halves connected by an underside hinge 52 and folded in a concertina fashion in a similar manner to the folding action shown in FIG. 3 through the arc shown by arrow 53. The lower tread 47 folds in a similar manner to the intermediate tread 43 through the arc shown by arrow 54.

The frameworks forming the end frames, side frames and sub-frames may be fabricated in any known or convenient manner but in the preferred form of the invention are formed from rectangular hollow section tubing by welding or riveting as shown in FIG. 7. Where desired the corners of all of the frames may be reinforced by triangular gussets 55. Similarly the platforms such as those shown at 8 and 9 may be formed from any suitable material, which is preferably plywood or particle board or some other form of timber flooring, but which may alternatively be other fabricated constructions such as metal frame or expanded metal mesh configurations.

Although the staging folds to a very compact size very simply and quickly the assembled staging is very rigid and robust and therefor safe because of the integral permanent nature of the various frames and sub-frames, and because of the locking provided by the engaging means in the form of the pins 12 and the holes 13.

I claim:

1. A collapsible staging, comprising:

a. a first modular section comprised of first and second end frames at either end thereof and side frames between said end frames, said side frames each comprising two rectangular subframes hinged together by a vertical central hinge along their common vertical edges and being connected to said end frames by vertical end hinges along the edges remote from the central hinge, said hinges being arranged such that the central hinges of opposite side frames can be moved toward one another causing the side frames to fold inwardly in a certain fashion as the end frames are moved toward one another, said first modular section further incorporating a platform adapted to be placed and supported by the upper peripheries of at least some of said frames when said frames are in an extended position, and engaging means between said platform and said frames adapted to prevent hinging movement of said frames, one relative to the other, when engaged with said platform;

b. a second modular section, positioned end to end relative to said first modular section, said second modular section comprising at least one end frame to an end thereof, and side frames between end frames of said second modular section, said side frames each comprising two rectangular subframes hinged together by a vertical central hinge along their common vertical edges and being connected to end frames by vertical end hinges along the edges remote from the central hinge, said hinges being arranged such that the central hinges of opposite side frames can be moved toward one another causing the side frames to fold inwardly in a concertina fashion as the end frames are moved toward one another, said second modular section further incorporating a platform adapted to be placed on and supported by the upper peripheries of at least some of said frames, and engaging means between said platform and said frames adapted to prevent hinging movement of said frames, one relative to the other, when engaged with said platform; and c. each said respective platform being formed from a plurality of sheet-like members each hinged one to the other and removable form the upper peripheries of said frames in the folded position of the frames and adapted to be arranged in a layflat condition against at least one end frame of a respective one of the associated modular sections of the folded collapsible staging.

2. A collapsible staging as claimed in claim 1, wherein one end frame of said first modular section comprising a common end frame with said second modular section.

3. A collapsible staging as claimed in claim 1, wherein said end frames, side frames and sub-frames are all rectangular and substantially the same height, and wherein each platform comprises a flat, level platform supported by the upper peripheries of said frames.

4. A collapsible staging as claimed in claim 1, wherein each platform is hinged to the upper edge of at least one end frame by a base hinge.

5. A collapsible staging as claimed in claim 4, wherein each platform is formed from a plurality of sheet-like members, each hinged one to the other by hinges parallel to said base hinge, and arranged so that said platform may be folded in an accordion like manner.

6. A collapsible staging as claimed in claim 1, wherein said engaging means comprise pins extending from one of each platform or the upper peripheries of said frames and engaging in holes in the other of each platform or said upper peripheries of said frames.

7. A collapsible staging as claimed in claim 6, wherein said pins are fixed to the underside of each platform and protrude downwardly therefrom engaging with holes in the upper edges of said frames.

8. A collapsible staging as claimed in claim 1, wherein said frames are fabricated from rectangular section metal tubing and each platform is formed from sheet material such as plywood or particle board.

* * * * *